United States Patent [19]

Hofer et al.

[11] 3,960,129

[45] June 1, 1976

[54] COMPENSATED SEMICONDUCTOR IGNITION SYSTEM FOR INTERNAL COMBUSTION ENGINES

[75] Inventors: Walter Hofer, Schwabach; Georg Haubner, Berg; Peter Schmaldienst, Nurnberg, all of Germany

[73] Assignee: Robert Bosch G.m.b.H., Gerlingen-Schillerhohe, Germany

[22] Filed: Feb. 3, 1975

[21] Appl. No.: 546,195

Related U.S. Application Data

[62] Division of Ser. No. 330,689, Feb. 8, 1973, abandoned.

[30] Foreign Application Priority Data

Mar. 10, 1972 Germany ..... 2211534

[52] U.S. Cl. ..... 123/148 CC; 123/149 R; 315/223

[51] Int. Cl.[2] ..... F02P 5/04

[58] Field of Search ..... 123/148 CC, 149 R, 148 E, 123/117 R; 315/223

[56] References Cited

UNITED STATES PATENTS

| | | | |
|---|---|---|---|
| 3,186,397 | 6/1965 | Loudon | 123/148 CC |
| 3,240,198 | 3/1966 | Loudon et al. | 123/148 CC |
| 3,495,579 | 2/1970 | Davalillo | 123/149 |
| 3,505,563 | 4/1970 | Randall et al. | 315/223 |
| 3,515,109 | 6/1970 | Farr | 123/148 CC |
| 3,587,549 | 6/1971 | Kebbon | 123/149 |
| 3,648,675 | 3/1972 | Germander | 123/149 |
| 3,741,185 | 6/1973 | Swift et al. | 123/149 |
| 3,878,824 | 4/1975 | Haubner et al. | 123/148 E |
| 3,898,972 | 8/1975 | Haubner | 123/117 R |

OTHER PUBLICATIONS

"Breakerless High-Frequency Ignition System," McClelland, et al., July '63, pp. 74–78, SAE Journal.

*Primary Examiner*—Charles J. Myhre
*Assistant Examiner*—Paul Devinsky
*Attorney, Agent, or Firm*—Flynn and Frishauf

[57] ABSTRACT

To prevent spurious responses of a semiconductor switching element used in triggered magneto-type semiconductor ignition-switching systems, primarily due to noise signals introduced by the magneto, the control circuit for the ignition system includes a common, parallel connected R/C compensation circuit, connected through decoupling diodes to the ignition trigger pulse sources for the respective cylinders and the grounded main terminal of the switching element to supply a compensating voltage which suppresses noise voltages which increases with increasing speed of the internal combustion engine and thus dynamically compensates for generated noise pulses.

8 Claims, 9 Drawing Figures

COMPENSATED SEMICONDUCTOR IGNITION SYSTEM FOR INTERNAL COMBUSTION ENGINES

This is a division of application Ser. No. 330,689, filed Feb. 8, 1973 now abandoned.

The present invention relates to an ignition system for internal combustion engines and more particularly to ignition systems which include electronic switching devices in the main circuit of the ignition system which also includes the ignition transformer, and which derives ignition energy from a magneto in which a rotating part, driven by the internal combustion engine, is magnetically coupled to a pulse source.

Ignition systems of this type provide control voltages at proper ignition time to the ignition system, so that an electronic switching element is properly switched if the internal combustion engine is operating in the proper direction of rotation. The control voltage can be directly or indirectly generated. In an ignition system using an ignition coil, it is customary to interrupt the main circuit by the electronic switching element, so that the inductive energy stored in the ignition coil can be used to generate the spark at the spark plug. Capacitor ignition discharge systems, on the other hand, provide a capacitor in the main ignition circuit which is discharged, at ignition time, by means of an electronic circuit element, in order to generate the spark impulse for the spark plug.

Such ignition systems may be controlled by a magnetic pulse source in order to provide for contact-less control of the electronic switching element. A magnetic pulse source suitable to be driven by an internal combustion engine utilizes a rotating part, for example a magnet or the like, cooperating with a flux guide element, such as pole shoes or the like. Such pulse sources which, broadly, may be termed transducers have the disadvantage that the magnetic element usually is not a completely shielded component, so that interfering magnetic fields, or changes in the magnetic relationships due, for example, to vibration, shock, or the like of the internal combustion engine, may lead to noise pulses and noise voltages at the pulse source. Such noise pulses and noise voltages arise particularly at higher speeds of the engine. Even at proper rotation of the engine, misfires may result. To prevent rotation of the engine in wrong, or reverse direction, it has been customary to so construct the flux guide or pole shoes that they have a steep, abruptly rising edge in the proper direction of rotation and a gradually tapering or flat edge in the wrong direction of rotation. The directional reliability of the engine is interfered with, particularly in higher engine speed ranges, by noise pulses which can be generated, for example due to shock vibration or the like.

It is an object of the present invention to provide a magnetic pulse source for use in the ignition system of a multi-cylinder internal combustion engine in which interfering voltages arising in the control circuit of electronic switching elements, located in the main circuit of the ignition system, are effectively suppressed or eliminated.

SUBJECT MATTER OF THE PRESENT INVENTION

Briefly, a common compensating element in the form of a parallel connected R/C circuit is included in the control circuit of the semiconductor switching element.

The R/C circuit is connected between the pulse sources to trigger ignition events for the respective cylinders and one, preferably the grounded, terminal of the switching element. The compensating element R/C circuit has a voltage applied thereto, which increases with increasing speed of the internal combustion engine. The voltage tends to suppress interfering or noise voltages or pulses from the pulse source, and the arrangement and circuit are so taken that the portion of voltage due to noise or interfering pulses of the overall pulse control voltage, applied to the switching element, is effectively compensated.

In accordance with an embodiment of the invention, the compensating element or circuit includes a temperature sensitive resistor, for example, a negative temperature resistor, a semiconductor array, an R-C circuit, which may include a temperature-dependent resistor, or the like.

The invention will be described by way of example with reference to the accompanying drawings, wherein.

Figure 1:
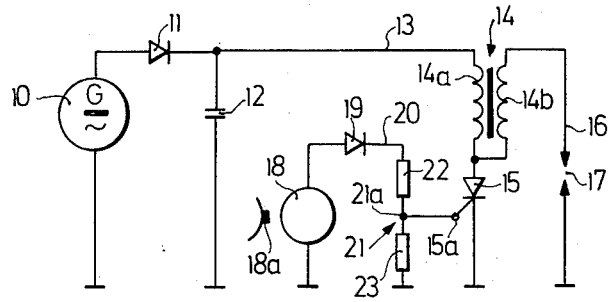
FIG. 1 is a general circuit diagram of a capacitor discharge ignition system having a semiconductor switching element in the ignition power circuit, and a magnetic pulse source in the control circuit for the semiconductor, which is connected to the semiconductor switching element over a voltage divider.

A one-cylinder internal combustion engine (not shown) drives a magneto generator 10, one terminal of which is connected to chassis or ground and the other over a diode 11 to a storage capacitor 12 which has its other terminal likewise connected to chassis. Primary winding 14*a* of ignition coil 14 is connected in parallel to storage capacitor 12. A thyristor 15, functioning as an electronic switching element is connected in series with the ignition coil 14. The storage capacitor 12, primary 14*a* and thyristor 15 form the main or ignition power circuit 13 of the ignition system. Secondary 14*b* of ignition transformer 14 is connected to the primary 14*a* and has its other terminal connected over ignition cable 16 with a spark plug 17.

Conduction of thyristor 15 is controlled by means of a control circuit which includes a pulse source 18 which has a flux guide element 18*a* and which, like magneto generator 10, is driven by the internal combustion engine. The magnetic pulse source 18 is connected to a diode 19 and supplies the control circuit 20. This control circuit 20 includes a compensation element 21, shown as a voltage divider having resistors 22, 23. The compensation element 21 is connected in parallel to the pulse source 18 and diode 19. One of the resistors 22, 23 is temperature-dependent, preferably highly temperature-dependent. The junction or tap point 21*a* between the resistors 22, 23 is connected to the control electrode 15*a* of thyristor 15. In the embodiment of FIG. 1, resistor 22 is a so-called cold conductor, that is, is a resistor which has a low resistance when cold, but a rapidly rising resistance as temperature increases.

Operation: Positive voltage half waves derived from the magneto generator 10 are applied over diode 11 to the storage capacitor 12 which will charge and, if the direction of rotation of the internal combustion engine is proper, will apply a voltage pulse over thyristor 15, at the proper time, to ignition coil 14. It is here assumed that thyristor 15 is switched into conductive state at the proper time. The energy stored in capacitor 12 discharges over the primary 14*a* of ignition transformer or ignition coil 14 and thyristor 15, providing a high voltage pulse in the secondary 14*b* of ignition coil 14 and thus a spark at spark plug 17.

The effective control voltage applied to the control electrode 15*a* of thyristor 15 depends on the voltage drop on resistor 23. Since resistor 22 is a cold-conductor, positive voltage pulses from pulse source 18, and connected over diode 19, cause only low heating at low ranges of speed of the engine. Its resistance will thus remain low. Due to the low voltage drop across resistor 22, the control voltage at tap 21*a* of the voltage divider will be only slightly below the voltage which is passed by diode 19. The circuit is so arranged that the control voltage will reach the triggering value of thyristor 15 at the ignition instant, in order to trigger thyristor 15 into conductive state. If the speed of the engine increases, so that the engine then operates at a high range of speed, noise voltage half waves from the pulse generator 18 will also be passed by diode 19 to be applied to the voltage divider 22, 23. Since the amplitudes of the control voltages and of the noise voltages increase in the pulse source, as the voltage increases, and since, further, the time gaps between voltage pulses become less as the speed increases, resistor 22 will begin to heat, thus increasing its resistance value rapidly. This increases the voltage drop across resistor 22 so that the increase of the voltage from the pulse source 18 as well as the positive noise voltage half waves are compensated. The tap point 21*a* of the voltage divider is thus placed at a voltage level with respect to the noise pulse level which is so low that the thyristor 15 is not spuriously triggered, since the control electrode 15*a* thereof will not have sufficient triggering voltage, due to noise pulses, applied. This effect will pertain over the entire range of speed of the engine. Basically, the system operates by maintaining the tap point 21*a* at a voltage level in which the absolute amplitude of the noise pulses is kept below the triggering voltage of the thyristor 15 by introducing variable resistance values and, so to speak, scaling down the voltages applied to the tap point to such a level that only the proper triggering pulses will approach, and exceed the triggering level of thyristor 15.

The flux guide element 18*a* of the pulse source 18 is so constructed that the direction of rotation of the internal combustion engine is important to provide the proper pulse. If the direction of rotation is wrong, then the positive voltage pulse necessary to fire thyristor 15 will not appear at a proper time in which the internal combustion engine has combustible explosive mixture therein. Thus, any spark which occurs on spark plug 17 upon discharge of the capacitor 12 will not be effective. Firing of thyristor 15 by noise pulses derived from pulse source 18 is prevented also if the direction of rotation is incorrect, since the cold conductor properties of resistor 22 will compensate for positive half waves of noise pulses.

The compensating element 21, in form of a voltage divider, can also be constructed differently: For example, resistor 23 may be a so-called hot temperature conductor, that is, a type of resistor in which, upon heating, the resistance drops, that is, a negative temperature coefficient resistor. Thus, in lower speed ranges, the resistance of resistor 23 will be high and thus the voltage at tap point 21*a* of the compensating element voltage divider will be high in relation to the overall voltage across the compensating element 21. In upper regions of speed, however, the resistance of resistor 23 will decrease, as more current passes through resistor 23 and as it will heat. This drops the voltage at tap 21*a* of the voltage divider in relationship to the overall voltage applied across both resistors 22, 23, the voltage drop across resistor 22 increases and the positive half waves of noise voltages from the pulse source will be compensated in the upper speed ranges due to the increased voltage drop across the resistor 22. Both effects, a cold-conductor resistor 22 and a hot-conductor resistor 23 can be combined, if desired.

Figure 2:
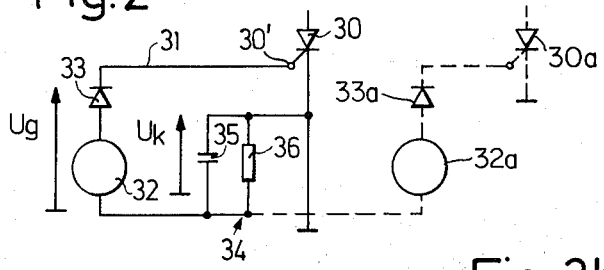
FIG. 2 illustrates the control circuit of a capacitor discharge system having a magnetic pulse source with a compensation element.

FIG. 2 illustrates the control circuit to control an electronic switching element located in the main or power ignition circuit of a capacitor discharge system, described and explained in connection with FIG. 1. The electronic switching element is a thyristor 30 having its anode connected to the ignition coil, not shown in FIG. 2. Its cathode is grounded. A control circuit 31 is supplied by a magnetic pulse source 32 connected over a diode 33 to the control electrode 30' of thyristor 30. The other terminal of the pulse source 32 is connected to a compensation network 34, which includes a capacitor 35 and a resistor 36, connected in parallel. Compensation circuit 34 closes the circuit between cathode of thyristor 30 and pulse source 32. For use with multicylinder engines, separate pulse sources 32, 32*a* are connected in accordance with the dotted line, on the one hand to the compensation circuit 34, which will be common for all pulse sources, and on the other to a respective associated thyristor 30*a*. The respective pulse sources 32, 32*a* are decoupled by individual decoupling diodes 33, 33*a*.

Figure 3A:
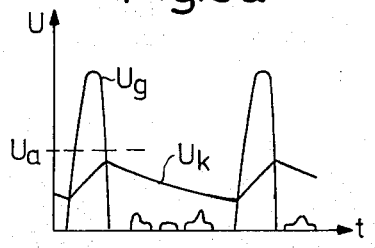
FIGS. 3*a* and 3*b* are time-voltage diagrams of pulse source voltage and compensation voltage of the circuit of FIG. 2, with FIG. 3*a* illustrating the voltage relationships in a lower speed range, and FIG. 3*b* illustrating the relationships in an upper speed range.
Figure 3B:
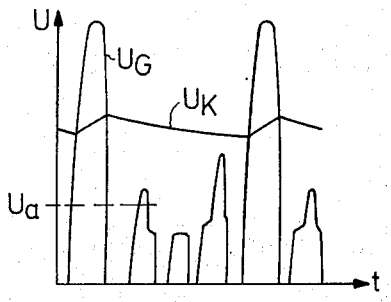

Operation (with reference to FIGS. 3*a* and 3*b*). The voltage of the pulse source 32 and of diode 33 is shown by curve $U_g$; the compensation voltage is shown by curve $U_k$. FIG. 3*a* refers to low speed ranges. FIG. 3*b* shows the same voltages in high speed ranges. The line representing $U_a$ is the response voltage of thyristor 30.

Let it be assumed that the internal combustion engine is a two-stroke engine, then upon each revolution of pulse source 32, a voltage pulse is generated at the proper ignition time. Thyristor 30 is thus fired to switch into conductive state. The voltage pulse charges capacitor 35 only partially when the speed is in the lower speed range, and thus the compensation voltage $U_k$ has only a relatively low value. Capacitor 35 then discharges over resistor 36 until a further pulse derived from the pulse source 32, upon continued rotation of the internal combustion engine, is passed over diode 33 to trigger the thyristor, and to provide for a renewed partial charge on capacitor 35. The noise pulses which arise in the meanwhile, between occurrences of the ignition pulses, are so small that they are well below the response level voltage $U_a$ of thyristor 30. The control voltage $U_{st}$ which is measured between control electrode 30' and the cathode of thyristor 30 then is derived from the equation:

$$U_{st} = U_g - U_k \quad (1)$$

The compensation voltage $U_k$ is so selected, by suitable dimensioning of the compensation circuit 34, that it is always greater over the entire range of speed of the engine than the noise amplitudes. This ensures that the noise voltages are completely compensated by the compensation voltage $U_k$.

The upper speed range operation is shown in FIG. 3*b*. As is clearly seen, the response voltage $U_a$ of thyristor 30 is less than the noise amplitudes from the magneto. Yet, the noise amplitudes are ineffective since they are compensated by the higher compensation voltage $U_k$. In upper speed ranges, the compensation voltage $U_K$ will be higher since the control pulses derived from the control source, of voltage $U_G$ will also be much higher. Further, the time intervals between controlled pulses become less. Capacitor 35 thus is charged to a higher voltage value and can be discharged only to a lesser level between pulse intervals, over resistor 36. The voltage level $U_a$ in FIG. 3*b* is shown from zero reference although, of course, this voltage itself is effective on the thyristor only between the terminals of the compensation element and the gate electrode 30*a*. The decoupling diodes 33, 33*a* prevent negative charging of the R/C compensation circuit 34, and prevent time delay upon charge reversal on the capacitor 35, which would arise if the diodes 33 were absent, through the associated resistor 36 of the parallel compensation circuit 34.

Figure 4:
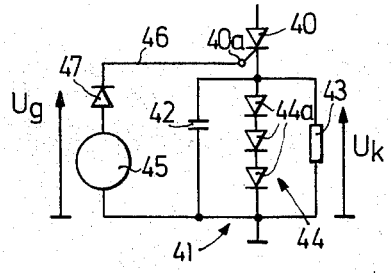
FIG. 4 is a fragmentary circuit diagram of a magnetic pulse source and a compensation element in the discharge circuit of an ignition system.

Embodiment of FIG. 4: Thyristor 40 is switched by triggering its gate electrode 40*a*. Thyristor 40 is connected in an ignition circuit similar to thyristor 15 of FIG. 1. Thyristor 40 has its cathode connected to a compensation circuit 41, the other terminal of which is connected to ground or chassis. Compensation element 41 includes the parallel circuit of a capacitor 42, a resistor 43, and an array of semiconductor diodes 41, having a predetermined threshold level. Semiconductor array 44 itself consists of a group of series connected diodes 44*a*. Magnetic pulse source 45 supplies the control circuit 46 over a diode 47. The other terminal of pulse source 45 is connected to chassis, that is, to the other terminals of capacitor 42, resistor 43 and diode array 44.

Figure 5:
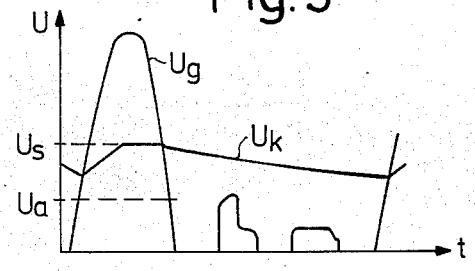
FIG. 5 is a time (abscissa) vs. voltage (ordinate) diagram of the compensation voltage and pulse voltage in an upper speed range of the engine.

Operation (with reference to FIG. 5): The pulse voltage derived across pulse generator 45 and diode 47 is shown as $U_g$, the compensating voltage as $U_k$, the threshold voltage of the semiconductor unit 41 as $U_s$ and the triggering voltage for the thyristor (starting from zero level) at $U_a$. Voltage $U_g$ charges capacitor 42 over diode 47 and the control path of the thyristor 40. Capacitor 42 then discharges over resistor 43. In the upper ranges of speed, the intervals between control pulses $U_g$ are so short that capacitor 42 is only slightly discharged over resistor 43 between two control pulses. In upper ranges of speed, charge of capacitor 42 is limited by the semiconductor array 41 having the threshold value $U_s$ since, when the threshold value $U_s$ is reached, it will become conductive. The threshold value of the semiconductor array $U_s$, obtained by serial connection of a group of diodes 44*a*, is so selected that the compensation voltage $U_k$ in upper ranges of speed exceeds the voltage of the half waves due to noise pulses derived from pulse source 45, so that these voltages are compensated and will not be effective on the control electrode 40*a* of thyristor 40. The semiconductor array 44 is provided in order to decouple the compensation element 41 during discharge of capacitor 12 (FIG. 1).

Figure 6:
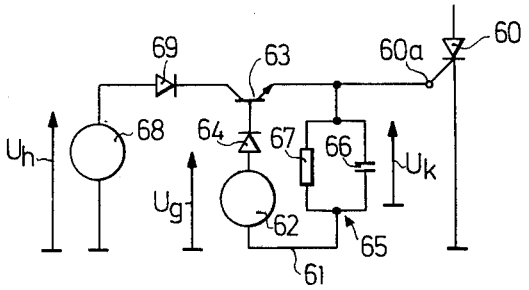
FIG. 6 is a circuit diagram of a magnetic pulse source and a compensation circuit including an auxiliary circuit to control the electronic circuit element of the ignition system.

Embodiment of FIG. 6: A thyristor 60, connected in an ignition system similar to that shown in FIG. 1 has its gate electrode 60*a* controlled from a magnetic pulse source 62 which is in circuit with a control transistor 63. The switching path of the control transistor is connected between an alternating current source and the control electrode 60*a* of thyristor 60. A compensation element 65 is connected to pulse source 62. Control transistor 63 can be an npn transistor, as shown, or a pnp transistor. The alternating current source is a generator 68 connected over a diode 69 with the collector of control transistor 63, and the control or gate electrode 60*a* of thyristor 60 is connected to the emitter of transistor 63. Compensation circuit 65 is likewise connected to the gate electrode 60*a*, and hence to the emitter of transistor 63. The compensation circuit includes a parallel connected resistor 67 and capacitor 66. Pulse source 62 is connected over diode 64 to the base of the transistor 63, and thus provides power to the control circuit 61, which includes diode 64, the base-emitter path of transistor 63 and the compensation circuit 65.

Figure 7:
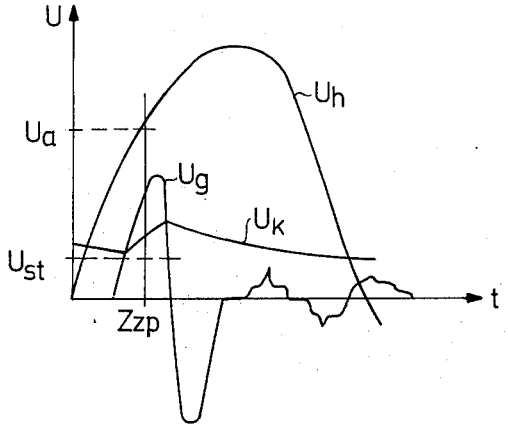
FIG. 7 is a diagram of auxiliary voltage and pulse control voltage as well as of compensation voltage, with respect to time, of the circuit of FIG. 6.

Operation (with reference to FIG. 7): The curves shown in FIG. 7 have been given the same notation as the curves of FIG. 5; the additional curve $U_h$ illustrates the positive half wave of the auxiliary voltage derived from source 68, as rectified by diode 69. FIG. 7 illustrates the voltage in the control circuit of thyristor 60. If the internal combustion engine operates in proper direction, then the control pulses of the control voltage $U_g$ are timed to fall within a positive half wave of the auxiliary voltage $U_h$, which is connected over diode 69 to the collector of transistor 63. The positive pulse $U_g$ derived from the pulse source charges capacitor 66 of the compensation element 65 over diode 64 and the base-emitter path of transistor 63. Transistor 63 becomes conductive and thyristor 60 is switched into conductive condition by the positive auxiliary voltage $U_h$. Capacitor 66 will discharge in the time interval between control pulses of source 62 at least partly over resistor 67. The control voltage for the transistor 63 is defined by $$U_{st} = U_g - U_k \quad (2)$$

The compensation element is suitably dimensioned to ensure that in upper speed ranges the noise voltages from pulse source 62 are below the compensation voltage $U_k$, so that they cannot become effective with respect to the control voltage $U_{st}$ on transistor 63. The control voltage is held to such a value that it does not reach the response or threshold voltage of thyristor 60, to further ensure that thyristor 60 can switch into conductive condition only when simultaneously the auxiliary voltage $U_h$ is (a) positive; (b) exceeds the response or threshold level voltage $U_a$ of thyristor 60 and (c) transistor 63 has been rendered conductive at the ignition timing instant Zzp by a control impulse from control source 62. This ensures that the auxiliary voltage $U_a$ will be transmitted over the collector-emitter path of the transistor 63 to the gate electrode 60*a* of thyristor 60. If the direction of rotation is wrong, then the auxiliary voltage $U_h$ will be negative at the ignition instant Zzp, and thus cannot fire transistor 60.

Figure 8:
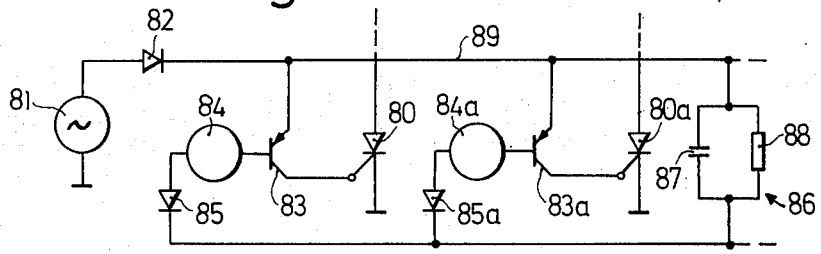
FIG. 8 is a fragmentary schematic diagram of a control circuit for multi-cylinder internal combustion engines having several magnetic pulse sources and one compensation circuit.

FIG. 8 illustrates the circuit for an ignition system for a multi-cylinder internal combustion engine which does not utilize a distributor. Thyristors 80, 80*a*, each, are connected to an ignition coil, the secondaries of which are connected to respective spark plugs. The primaries of the ignition coils are connected to a common storage capacitor. Thyristors 80, 80*a* are controlled by an auxiliary voltage which is generated by a generator 81 and connected over a diode 82 as well as over the control path of transistors 83, 83*a*, respectively, to the control electrode of the respective thyristor 80, 80*a*. The control transistors 83, 83*a* are controlled by a magnetic pulse source 84, 84*a*. The control path of the respective control transistor 83, 83*a* is connected in circuit with the respective pulse sources 84, 84*a*. The emitters of pnp control transistors 83, 83*a* are connected over a common line 89 to generator 81. The bases of control transistors 83, 83*a* are connected to the respective pulse sources 84, 84*a*, which are all connected to a common compensation circuit 86. Circuit 86 comprises a parallel connection of a capacitor 87 and a resistor 88. Diodes 85, 85*a* between the generators 84, 84*a*, respectively, and the compensation circuit 86 are provided to decouple the various circuits from each other, specifically to decouple the pulse sources. The compensation element 86 is connected over line 89 with the emitters of control transistors 83, 83*a* and over a line 90 with the cathodes of diodes 85, 85*a*.

Operation: Essentially, the operation is similar to that described in connection with the circuit of FIG. 6 and the graph of FIG. 7. Pulse source 84, 84*a* charges capacitor 87 of compensation circuit 86 over the control path of the transistors 83, 83*a*, respectively, at each control pulse. Due to the rapid sequence of pulses of the ignition system, the compensation circuit 86 must be so dimensioned that the capacitor 87 can be discharged in the intervals between the sequential control pulses of pulse sources 84, 84*a* sufficiently so that the control transistors 83, 83*a* will switch over when the control pulses are applied thereto. In upper regions of speed, the compensation voltage $U_k$ rises to such an extent that the noise voltages derived from pulse sources 84, 84*a* rendered ineffective at the control transistors 83, 83*a*.

Various changes and modifications may be made and the invention is not limited to the examples shown. Various circuit elements of the various examples can be interchanged and connected interchangeably. The compensation element can also be formed as a generator which provides a compensation voltage equal and opposite to that of the pulse source voltage and increasing with increasing speed of the engine and of the pulse source.

We claim:

1. Ignition system for a multi-cylinder internal combustion engine having a main ignition circuit including an ignition coil (14), spark plug means (17) connected to the ignition coil, and controlled switching element means (30, 30*a*, 40, 60, 80, 80*a*) having main terminals and a control terminal, and controlling current flow through the coil;

a plurality of magnetic pulse source means (32, 32*a*, 45, 68, 84, 84*a*) magnetically coupled to a rotating element of the system;

a plurality of diodes (33, 33*a*, 47, 69, 85, 85*a*), each connected in series with a respective pulse source means to pass only pulses of one polarity, the pulse source means - diode circuit combinations being connected with one output terminal to the control terminal of the controlled switching element means to trigger said element and control switching action thereof;

a common resistor-capacitor (R/C) circuit (35, 36; 42, 43, 44*a*; 66, 67, 87, 88) forming a compensation circuit (34, 41, 65, 86) in which the resistance portion and the capacitance portion of the circuit are connected in parallel, connecting the other respective terminals of each of the pulse source means-diode combinations (32–33; 32*a*–33*a*; 45–47; 68–69; 84–85; 84*a*–85*a*) to one of the main terminals of the controlled switching element means (30, 30*a*, 40, 60, 80, 80*a*) whereby the common compensation circuit (34, 41, 65, 86) is connected in the circuit path between the main terminal of the controlled switching element means and said other terminal of the pulse source means.

2. System according to claim 1, wherein the controlled switching element means comprises thyristors (30, 30*a*, 40, 60, 80, 80*a*).

3. System according to claim 1, wherein the resistance portion of the resistor-capacitor circuit forming the compensation circuit (41) includes a fixed resistor (43) and a semiconductor means (44) having a predetermined voltage threshold level ($U_s$) connected in parallel to the fixed resistor (43) in the compensation circuit.

4. System according to calim 3, wherein the semiconductor means (44) comprises a group of serially connected diodes (44*a*).

5. System according to claim 1, wherein the diodes (33, 33*a*; 47, 69, 85, 85*a*) are connected in series between the said respective one output terminal of the magnetic pulse source means (32, 32*a*, 45, 68, 84, 84*a*) and the respective control terminals of the respective controlled switching element means.

6. System according to claim 1, comprising a common pulse source (81);

a plurality of controlled transistors (83, 83*a*) having their control terminals connected to said one output terminal of respective pulse source means (84, 84*a*), one main terminal of the control transistors (83, 83*a*) being connected to said common pulse source (81), the other main terminals of the transistors (83, 83*a*) being connected to the respective control terminals of the respective switching element means (80, 80*a*) to control sparking of the respective spark plugs.

7. System according to claim 1, comprising a common pulse source (81) having one terminal (ground) connected to said one main terminal (ground) of all of the controlled switching elements (80, 80*a*);

a plurality of switching transistors (83, 83*a*) having all their respective emitters connected to the other terminal of the common pulse source (81), their respective bases to said one terminal of the respective pulse source means (84, 84*a*) and their respective collectors to the respective control electrodes of the respective switching element means (80, 80*a*), the common compensating circuit (86) being connected between all of the emitters of the transistors (83, 83*a*) and all of the respective other terminals of all of said respective pulse source means (84, 84*a*).

8. System according to claim 1, wherein said one main terminal of the controlled switching element means (30, 30*a*, 40, 60, 80, 80*a*) and one terminal of the pulse source means - diode combinations (32–33; 32*a*–33*a;* 45–47; 68–69; 84–85; 84*a*–85*a*) are connected to chassis, or ground of the system.

* * * * *